United States Patent [19]

Germann

[11] Patent Number: 5,009,156

[45] Date of Patent: Apr. 23, 1991

[54] MULTI-COLOR ROTARY PRINTING MACHINE FOR SIMULTANEOUS RECTO-VERSO PRINTING

[75] Inventor: Albrecht J. Germann, Wurzburg, Fed. Rep. of Germany

[73] Assignee: De La Rue Giori S.A., Lausanne, Switzerland

[21] Appl. No.: 347,402

[22] Filed: May 4, 1989

[30] Foreign Application Priority Data

May 18, 1988 [CH] Switzerland ..... 1887/88

[51] Int. Cl.[5] ..... B41F 5/16; B41F 5/22; B41L 15/10

[52] U.S. Cl. ..... 101/177; 101/179; 101/182

[58] Field of Search ..... 101/177, 179, 178, 180, 101/181–185, 217, 220–222, 137, 138, 139–143, 144, 145

[56] References Cited

U.S. PATENT DOCUMENTS

| | | | |
|---|---|---|---|
| 4,441,423 | 4/1984 | Germann | 101/177 |
| 4,640,189 | 2/1987 | Hernandez | 101/177 |
| 4,651,644 | 3/1987 | Kaempfe et al. | 101/423 |

FOREIGN PATENT DOCUMENTS

| | | | |
|---|---|---|---|
| 92887 | 11/1983 | European Pat. Off. | 101/177 |

*Primary Examiner*—J. Reed Fisher
*Attorney, Agent, or Firm*—Kane, Dalsimer, Sullivan, Kurucz, Levy, Eisele and Richard

[57] ABSTRACT

The printing machine has two interacting blanket cylinders (4, 14), between which the paper to be printed runs through, thereby being printed on both sides, two plate cylinders (5, 15), each of which carries a collect-printing plate and is in contact with one of the blanket cylinders, and two color-collecting cylinders (6, 16) which are arranged at a distance from one another and each of which is in contact with a plate cylinder (5, 15) and with several color selector cylinders (8, 18), each inked by an inking unit (9, 19). Moreover, the two blanket cylinders (4, 14) are each in contact with the plate cylinder (10, 20) of an additional printing unit which is a wet offset-printing unit working with a dampened intaglio printing plate. Thus, in one printing operation, banknotes can be produced, on the one hand, with a multi-color safety background according to the collect-printing process and, on the other hand, each with a single-color main design according to the wet offset-printing process, and furthermore the said intaglio printing plates can also have an additional background which is superposed on the multi-color background according to the collect-printing process.

7 Claims, 1 Drawing Sheet

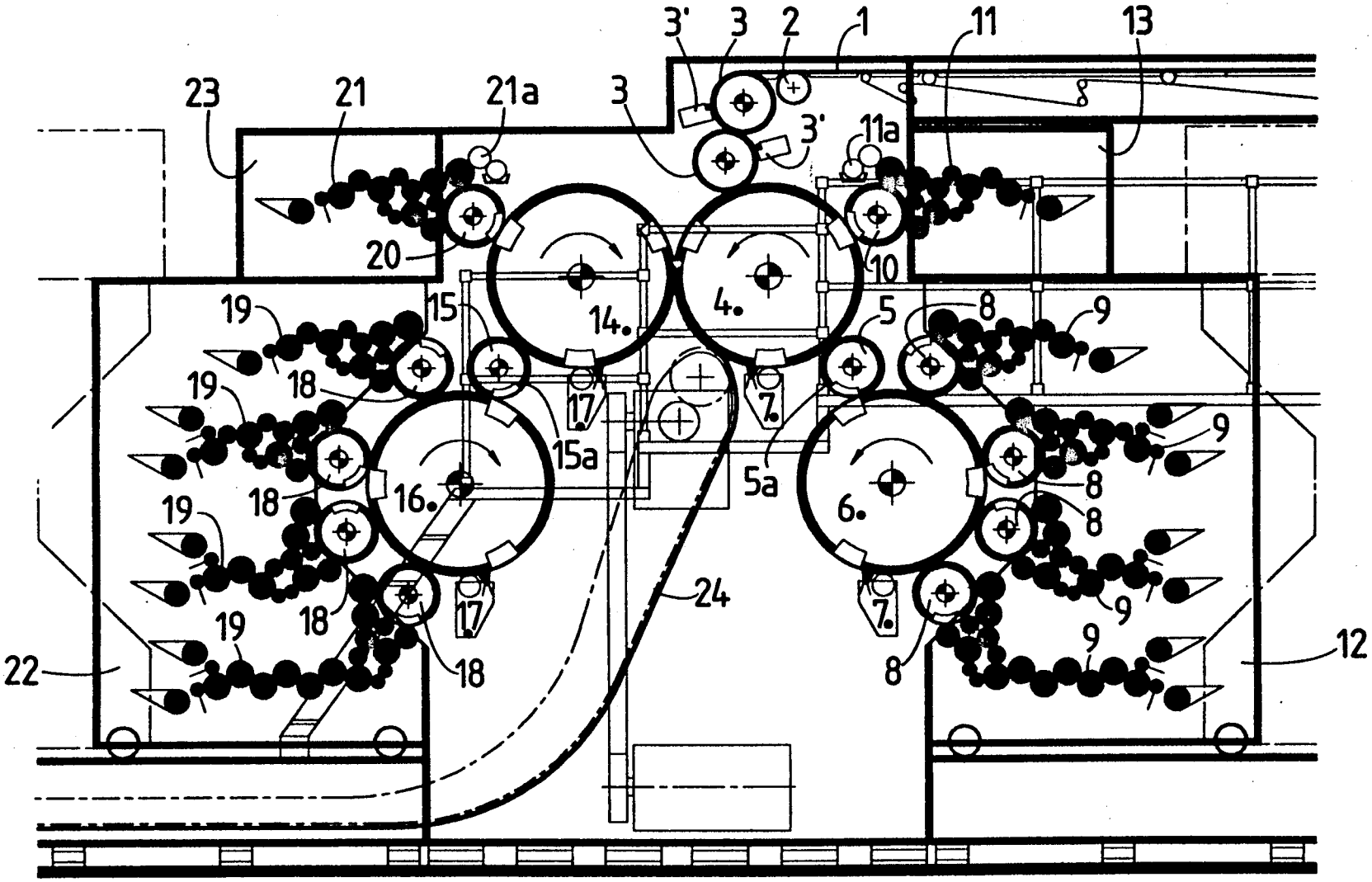
1
2
3
3'
3
3'
4
5
5a
6
7
7
7
8
8
8
9
9
9
10
11
11a
12
13
14
15
15a
16
17
17
18
18
18
19
19
19
19
20
21
21a
22
23
24

MULTI-COLOR ROTARY PRINTING MACHINE FOR SIMULTANEOUS RECTO-VERSO PRINTING

FIELD OF THE INVENTION

The invention relates to a sheet-fed or web-fed multi-color rotary printing machine for simultaneous recto-verso printing, especially for printing the safety background on security papers, above all banknotes, according to the preamble of patent claim 1.

PRIOR ART

A published German Patent Application (DE-A-3,109,964) has already described a printing machine of this type, which allows an image with colors lying next to one another to be printed on each side of the paper. Each image is printed by means of a single collect-printing plate in the form of a typographic printing plate which has the complete printing design and which is installed on one of the said plate cylinders. This typographic printing plate is inked by a color-collecting cylinder formed by a blanket cylinder and itself inked by several color selector cylinders, the number of which corresponds to the number of colors of an image to be printed. Each color selector cylinder carries cut-out relief zones representing the image regions to be inked with specific colors and receives the particular color from its own inking unit assigned to it. This printing machine serves, above all, for printing the safety background on banknotes.

To obtain simultaneous printing on both sides, the paper runs between the two blanket cylinders which are pressed against one another and which transfer the image on the one or other inked typographic printing plates onto the one or other side of the paper respectively.

By means of this process which is generally called the "Orlof" process or color-collect printing, a multi-color image with a perfect register between the various colors of the image design is obtained; this result cannot be achieved with any other printing process.

Since the color selector cylinders are in contact with the elastic surface of the color-collecting cylinder, they can made of a hard material, thus making it possible to cut-out very fine relief zones and therefore very fine inking regions, for example in the form of lines or dots.

SUMMARY OF THE INVENTION

The object on which the invention is based is to improve a printing machine of the above described known type, in such a way that, in one and the same printing operation, an additional print can also be obtained on one side of the paper or on both sides, thereby affording the possibility, particularly where the printing of banknotes is concerned, as early as during a single run through the machine, of finish-printing the banknote, that is to say with a safety background and a main design, on at least one side and/or of increasing the safety against counterfeiting.

According to the invention, this object is achieved by means of the features indicated in the defining clause of claim 1.

By means of this additional printing unit which inks one of the blanket cylinders directly, it is possible, together with the multi-color safety background produced according to the collect-printing process, to provide either a single-color main design, an additional further safety background increasing the safety against counterfeiting or preferably both a main design and an additional safety background. Since the additional printing image or printing design is preferably superposed on the multi-color collect-printing design, especially the safety background, an especially high degree of safety against counterfeiting is obtained. The fact that the additional printing unit works by a different printing process from that of the collect-printing unit also contributes to this safety.

Preferably, for each of the two blanket cylinders there is provided at least one additional printing unit, so that both sides of the paper can be printed in the way described during a single run-through of the paper. Of course, two or, if appropriate, more additional printing units can also be installed along the free circumference of each of the two blanket cylinders, so that multi-color main designs and/or additional multi-color designs for the safety background can also be produced.

The advantageous embodiments of a printing machine according to the invention which are given in claims 2 to 4 are characterized in that they allow easier access to all the parts of the machine, this being essential for the setting-up and maintenance of the printing machine, but without an excessive increase in the overall dimension of the machine, above all its total width.

Further expedient forms of the invention emerge from the remaining dependent claims.

BRIEF DESCRIPTION OF THE DRAWINGS

The invention is explained in detail by means of an exemplary embodiment with reference to the drawing.

The single FIG. 1 shows diagrammatically the exemplary embodiment of a sheet-fed printing machine.

DESCRIPTION OF THE PREFERRED EMBODIMENT

The sheet-fed printing machine illustrated has an in-feed device which supplies the paper 1 in sheet form and which is equipped with stop drum 2, with transfer drums 3 provided with grippers, and with a paper dedusting and anti-static device 3' installed on both sides of the paper 1. The sheets are transferred onto a blanket cylinder 4 equipped with grippers and interacting with a further blanket cylinder 14 having the same diameter. The sheets run through between the two blanket cylinders 4 and 14 and are thereby printed simultaneously on both sides. The cylinders rotate in the directions indicated by arrows. After being printed, the sheets are transported by a chain-gripper system 24 onto a delivery stack or, if appropriate, to a machine which completes the printing.

With the exception of the devices transporting the sheets, the machine is composed of two symmetrical halves.

Each blanket cylinder 4 and 14 is in contact with a plate cylinder 5, 15 which is arranged in its lower circumferential region and which carries a collect-printing plate **5*a*, 15*a*** in the form of a typographic printing plate.

Arrange offset symmetrically outwards underneath the blanket cylinders 4, 14 and the plate cylinders 5, 15 are two color-collecting cylinders 6 and 16 which are installed at a distance from one another and have the same diameter as the blanket cylinders 4, 14 and of which one touches the plate cylinder 5 and the other the plate cylinder 15.

In the example under consideration, each of the color-collecting cylinders 6, 16, which are blanket cylinders, interacts with four color selector cylinders 8, 18 which have cutout reliefs 8*a*, 18*a* corresponding to the contour of the regions to be printed in the particular color. Each color selector cylinder 8, 18 is inked with this color by means of an inking unit 9, 19. In the example under consideration, the upper two inking units each have one ink fountain, whilst all the remaining inking units each have a double ink fountain. All the inking units 9 are located on a removable inking-unit stand 12, all the inking units 19 are located on the removable inking-unit stand 22..

The color selector cylinders 8, 18 are preferably made of a hard material which does not run the risk of deforming, even when the relief is very fine, so that a safety background composed of very fine lines can be obtained.

The regions of the four colors are transferred from the color selector cylinders 8, 18 to the color-collecting cylinder 6, 16, on which they are combined and by means of which they are transferred onto the respective collect-printing plate 5*a*, 15*a* of the plate cylinder 5, 15. This collect-printing plate 5*a*, 15*a* represents the complete printing design to be printed in the four colors, especially a respective safety background. The two complete designs inked with the various colors are themselves transferred onto the blanket cylinders 4, 14.

Installed under each blanket cylinder 4, 14 and each color-collecting cylinder 6, 16 are respective automatic blanket-washing devices 7, 17, by means of which the respective blankets can be washed when no printing takes place and which are, of course, moved away from these cylinders during printing.

Furthermore, there is at least one additional printing unit, the plate cylinder of which interacts with one of the blanket cylinders 4, 14 and which works by a different printing process from the collect-printing process.

In the example under consideration, each of the two blanket cylinders 4 and 14 is in contact with the wet offset-plate cylinder 10, 20 of the respective wet offset-printing unit which is equipped with its own inking unit 11, 21 and with a dampening unit 11*a*, 21*a*. The wet offset-printing plate used is preferably an intaglio printing plate, the non-printing surface of which is made ink-repellent as a result of dampening. One inking unit 11 and the dampening unit 11*a* are installed on an inking-unit stand 13 which is fastened to the top of the removable inking-unit stand 12 and which is moved together with this; the other inking unit 21 and the dampening unit 21*a* are installed on an inking-unit stand 23 which is fastened to the top of the removable inking-unit stand 22 and which is moved together with this.

The blanket cylinders 4, 14 transfer onto the two sides of the paper the multi-color collect-printing designs, which they receive from the collect-printing plates 5*a*, 15*a* of the plate cylinders 5, 15, and at the same time the single-color images coming from the respective plate cylinders 10, 20 of the wet offset-printing units, these images being superposable on the multi-color collect-printing design. In banknote printing, these images produced by the wet offset-printing units are preferably each both a main design of the banknote and an additional safety background, the generally fine lines of which are superposed on the multi-color safety background produced by the collect-printing process and therefore give the banknote made an especially high degree of safety against counterfeiting. Thus, with the illustrated printing machine according to the invention, a banknote printed completely on each of the two sides with a multi-color safety background and a single-color main design is obtained in a single printing operation and during a single run through of the paper, the safety background consisting of a four-color collect-printing design and of an additional single-color safety-background design which is superposed on this and which, like the main design, is produced by wet offset printing.

Since there is sufficient free space along the surface of the two blanket cylinders 4 and 14 because of the special arrangement of all the cylinders, of course there can also be more than only one respective additional printing unit interacting with each of the blanket cylinders 4 and 14, for example two or even three respective printing units. Instead of working with intaglio printing plates which make it possible to produce especially fine and richly shaded designs and images, these printing units can also work with dry offset-printing plates or conventional wet offset-printing plates.

The diameter of the blanket cylinders 4 and 14 and of the color-collecting cylinders 6 and 16 is an integral multiple of, in the example under consideration three times the diameter of the color selector cylinders 8 and 18 of the plate cylinders 5, 15, 10 and 20.

The plane passing through the axes of the cylinders 6 and 4 intersects the plane passing through the axes of the cylinders 16 and 14 above the blanket cylinders 4, 14 at an angle which is approximately 60° in the example under consideration, so that the free space between the color-collecting cylinders 6 and 16 in this instance corresponds to just 1.5 times the cylinder diameter. In general, the said angle can amount to between 40° and 120°, preferably between 50° and 70°. Such an arrangement allows ready access to all the cylinders, this being important for the setting-up and maintenance of the printing machine, but at the same time avoids an undesirably large space required by the printing machine.

The printing machine according to the invention can also be a web-fed printing machine, in which case the sheet guide members are merely replaced by the known guide members for a paper web.

We claim:

1. A multi-color rotary printing machine for simultaneous recto-verso printing, especially for printing the safety background on security papers, means for feeding paper through said printing machine, with two interacting blanket cylinders (4, 14), between which the paper (1) to be printed runs through, thereby being printed on both sides, two plate cylinders (5, 15), each of which carries a respective collect-printing plate (5*a*,15*a*) and is in contact with one of the two blanket cylinders (4, 14), several color selector cylinders (8, 18), two color-collecting cylinders (6, 16) which are arranged at a distance from one another and each of which is in contact on the one hand with one of the plate cylinders (5, 15) and on the other hand with a respective one of said several color selector cylinders (8, 18), each said color selector cylinder being inked by an associated inking unit (9, 19), each color-collecting cylinder transferring all the colors obtained from the color selector cylinders in contact with it onto the respective collect-printing plate, at least one additional printing unit having a plate cylinder, wherein at least one of the two blanket cylinders (4, 14) interacts with said at least one additional printing unit (10, 11, 11*a*; 20, 21 21*a*), the plate cylinder (10; 20) of which is in contact with the respective blanket cylinder (4; 14), the blanket cylinders (4, 14) and the color-collecting cylinders (6,

16) being of the same size and having a diameter which is an integral multiple of the diameter of the plate cylinders (5, 15, 10, 20) and of the color selector cylinders (8, 18), the two color-collecting cylinders (6, 16) being arranged symmetrically underneath the two interacting blanket cylinders (4, 14) and respectively offset obliquely outwards relative to these and being at a distance from one another which is at least as large as their diameter, the collect-printing plate cylinders (5, 15) being arranged on the top of the color-collecting cylinders (6, 16) and the underside of said color-collecting cylinders being freely accessible.

2. A printing machine as claimed in claim 1, wherein the axes of one blanket cylinder (4) and of one color-collecting cylinder (6) lie in one plane, on the one hand, and the axes of the other blanket cylinder (14) and of the other color-collecting cylinder (16) lie in another plane, on the other hand, said planes intersect above the two blanket cylinders at an angle of 40° to 120°.

3. A printing machine as claimed in claim 1, wherein the additional printing unit is an offset-printing unit.

4. A printing machine as claimed in claim 1, wherein the additional printing unit (10, 11, 11*a*; 20, 21, 21*a*) is a wet offset-printing unit with an intaglio printing plate dampened by a dampening unit (11*a*, 21*a*).

5. A printing machine as claimed in claim 1, wherein the collect-printing plates (5*a*, 15*a*) have respective multi-color printing designs for a particular safety background, and said additional printing unit (10, 11, 11*a*; 20, 21, 21*a*) has a printing plate carrying a main design for inking in one color.

6. A printing machine as claimed in claim 5, wherein the printing plate (10; 20) of the additional printing unit has, in addition to the main design, a further safety-background design for completing a multi-color safety background.

7. A printing machine as claimed in claim 1, wherein a removable automatic blanket-washing device (7, 17) is provided for each of the respective two blanket cylinders (4, 14) and for each of the respective two color-collecting cylinders (6;16) each blanket washing device being below each of the respective blanket and color-collecting cylinders to provide a predetermined amount of space.

* * * * *